US006625960B1

(12) United States Patent
Nambu

(10) Patent No.: US 6,625,960 B1
(45) **Date of Patent: *Sep. 30, 2003**

(54) APPARATUS FOR SORTING AND PACKAGING ARTICLES

(75) Inventor: Kunio Nambu, Nagaokakyo (JP)

(73) Assignee: Kabushiki Kaisha Naberu, Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/573,212

(22) Filed: May 19, 2000

(30) Foreign Application Priority Data

May 24, 1999 (JP) ..... 99-182201
May 9, 2000 (JP) ..... 2000-136325

(51) Int. Cl.[7] ..... B65B 3/28; B65B 35/32; B65G 47/44

(52) U.S. Cl. ..... 53/502; 53/534; 53/539; 53/247; 53/251; 198/523

(58) Field of Search ..... 53/534, 539, 247, 53/248, 250, 251, 502; 198/418.6, 523, 525, 530, 532, 534

(56) References Cited

U.S. PATENT DOCUMENTS 3,220,154 A * 11/1965 Van Der Schoot ..... 198/432
3,311,216 A * 3/1967 Jones ..... 198/444
3,481,103 A * 12/1969 Summerour ..... 53/248
3,722,173 A * 3/1973 Noguchi ..... 53/246
3,820,301 A * 6/1974 Willsey ..... 198/399
3,964,233 A 6/1976 Thomas
4,261,158 A * 4/1981 Van Kattenbroek ..... 193/32
4,383,613 A * 5/1983 van Kettenbroek ..... 209/514
4,765,124 A * 8/1988 Nakamura ..... 177/25.18
5,096,041 A * 3/1992 van Ravenhorst ..... 198/343.1
5,167,317 A * 12/1992 van der Schoot et al. ..... 198/469.1
5,232,080 A 8/1993 van Essen et al.
5,365,717 A * 11/1994 McKinlay ..... 53/111 R
5,918,726 A * 7/1999 Temmink ..... 198/370.03

FOREIGN PATENT DOCUMENTS

EP 0 390 241 10/1990
EP 0 560 458 A1 9/1993
GB 1 452 655 10/1976
JP 07-291213 11/1995

* cited by examiner

*Primary Examiner*—Rinaldi I. Rada
*Assistant Examiner*—Paul Durand
(74) *Attorney, Agent, or Firm*—Nixon & Vanderhye

(57) ABSTRACT

An apparatus for sorting and packaging articles includes: a pair of distributing conveyors which are respectively translated and convey articles; a pair of primary accommodating mechanisms each adapted to accommodate in a row articles distributed and released from each of the distributing conveyors; a pair of standby accommodating mechanisms each adapted to accommodate by types of groups of transferred articles in one or more groups those groups of articles which are each transferred collectively from each of the primary accommodating mechanisms; a pair of transferring mechanisms each adapted to receive the group of articles from each of the standby accommodating mechanisms; and a common filling mechanism for filling the groups of articles received from each of the transferring mechanisms into a predetermined container.

12 Claims, 4 Drawing Sheets

APPARATUS FOR SORTING AND PACKAGING ARTICLES

BACKGROUND OF THE INVENTION

1. Field of the Invention

The present invention relates to an apparatus for sorting and packaging eggs, fruits, and the like.

2. Description of the Related Art

In general, an apparatus for sorting and packaging eggs, for example, is comprised of a raw egg conveyor, a measuring device, a transfer device, a distributing conveyor, and packaging devices. Namely, eggs supplied by the raw egg conveyor are subjected to measurement of their individual weight by the measuring device, are then moved onto the transfer device, and are conveyed in a single row to the packaging devices by the single-line distributing conveyor.

The packaging devices are provided for the respective weight classifications of the eggs, e.g., 2L, L, M, MS, S, 2S, and nonstandards. The eggs conveyed in a single row by the distributing conveyor are distributed (sorted) and released onto a receiving portion of the packaging device corresponding to the weight classification to which they belong. Then, when one row of eggs, e.g., five eggs, in a number for accommodation in an accommodating container such as a packaging pack are collected in the receiving portion, the packaging device collectively discharges the relevant five eggs as a group into the accommodating container.

In conjunction with the trend in recent years toward manufacturing larger apparatuses for sorting and packaging eggs, their egg processing capability has improved remarkably to more than 30,000 eggs per hour, but there has been a demand for further improvement in the processing capability. To cope with such a demand, it is generally conceivable to increase the speed of the distributing conveyor for conveying the eggs in the single row or provide a plurality of lines of distributing conveyors.

However, since the eggs are very liable to become damaged, there is a limit to increasing the speed of the distributing conveyor, and to provide a plurality of lines of distributing conveyors the number of packaging devices must also be increased correspondingly, which is therefore uneconomical.

The distribution of the weight of eggs has a certain dispersion in which, with a central value (central egg weight) set as an apex, the farther away from the central value, the more the number of eggs in each weight classification decreases. Therefore, it can be expected that eggs are concentrated on a packaging device corresponding to a particular weight classification depending on cases. If eggs of the same standard are concentrated, though temporarily, in a particular packaging device and its processing capability is exceeded, it results in a decline in the overall processing capability of the apparatus.

To cope with the demand for improvement of the processing capability, an apparatus disclosed in U.S. Pat. No. 5,232,080 has been proposed. In this proposed apparatus, first-stage receiving portions whereby eggs which are released from a four-track distributing conveyor according to their weight classifications are respectively received one by one on a predetermined number of accommodating seats are provided underneath the respective tracks of the distributing conveyor. A transfer conveyor for transferring the predetermined number of eggs received from the first-stage receiving portions is provided below the first-stage receiving portions. Further, final-stage receiving portions are disposed whereby the predetermined number of eggs released from the transfer conveyor are collectively received by or into a predetermined number of accommodating seats and are collectively released to an accommodating container on a container conveyor.

However, with this apparatus, the receiving portions provided underneath the distributing conveyor receive the eggs released from the distributing conveyor, and release them immediately to the transfer conveyor serving as the packaging device, a standby space for temporarily storing the eggs between the receiving portions and the transfer conveyor is not provided. With this apparatus, therefore, the temporary concentration of the eggs of a particular weight classification cannot be coped with by a means which temporarily stores the eggs in the process in which the eggs are released from the receiving portions to the transfer conveyor. Hence, there is a problem in that the temporary concentration of the eggs directly leads to a decline in the overall processing capability of the apparatus.

In addition, JP-A-7-291213 discloses an apparatus which prevents a decline in the overall processing capability of the apparatus by coping with the temporary concentration of the eggs in a particular packaging device while enhancing the processing capability by providing two lines of distributing conveyors each adapted to convey eggs in a single row without increasing the number of packaging devices.

However, with the apparatus disclosed in JP-A-7-291213, since the receiving position of a pool section when the eggs are received from first-stage receiving portions and the release position of the pool section when the eggs are released to final-stage receiving portions are set at the same location (bent portion), the eggs cannot be released to the final-stage receiving portions while an empty pool section having no eggs accommodated in its accommodating seats is continuing the operation of receiving the eggs at the receiving position. Namely, in the apparatus disclosed in JP-A-7-291213, for instance, in a case where the eggs are continuously concentrated in both two lines of distributing conveyors, the pool sections corresponding to the two lines of distributing conveyors continuously perform the operation of receiving the eggs from the first-stage receiving portions. During this receiving operation, the eggs cannot be released from the pool sections to the final-stage receiving portions, so that the final-receiving portions are in an idle state. Hence, there is a problem in that the processing capability of the apparatus in and after the final-receiving portions drops.

The above-described problems can occur not only in the sorting and packaging apparatus for sorting eggs according to their weight classifications and packaging them according to these weight classifications, but also in the sorting and packaging apparatus for sorting fruits or the like according to classifications of such as size and/or color and packaging them according to these classifications.

SUMMARY OF THE INVENTION

The present invention has been devised in view of the above-described circumstances, and it is an object of the present invention to provide a sorting and packaging apparatus which is capable of appropriately coping with a case in which articles in a particular classification must be sorted and packaged in a temporarily concentrated manner, while enhancing the processing capability by translating two or more distributing conveyors for transporting the articles preferably in a single line without increasing the number of packaging devices.

To this end, in accordance with a first aspect of the invention, there is provided an apparatus for sorting and packaging articles, comprising: a plurality of distributing conveyors which are respectively translated and convey articles; a plurality of primary accommodating means which are respectively disposed below the plurality of distributing conveyors, and are each adapted to accommodate in a row articles distributed and released from each of the distributing conveyors; a plurality of standby accommodating means which are respectively disposed below the plurality of primary accommodating means, and are each adapted to accommodate by types of groups of transferred articles in one or more groups those groups of articles which are each transferred collectively from each of the primary accommodating means; a plurality of transferring means which are respectively disposed below the plurality of standby accommodating means, and are each adapted to receive the group of articles from each of the standby accommodating means; and common filling means which is disposed below the transferring means to fill the groups of articles received from each of the transferring means into a predetermined container, wherein the transferring means selectively transfers the groups of articles received from each of the standby accommodating means to the common filling means.

In accordance with a second aspect of the invention, in the apparatus for sorting and packaging articles according to the first aspect of the invention, each of the standby accommodating means has a plurality of standby mechanisms in each of which the group of articles from the primary accommodating means are kept on standby, and a transferring operation in which the group of articles are transferred from a preceding one of the standby mechanisms for keeping the group of articles from the primary accommodating means in a preceding manner to an ensuing one of the standby mechanisms following the preceding standby mechanism is effected on the basis of a state of standby of the group of articles in the ensuing standby mechanism.

In accordance with a third aspect of the invention, in the apparatus for sorting and packaging articles according to the first or second aspect of the invention, the common filling means has transporting means for transporting the groups of articles from each of the transferring means in a circulating system.

In accordance with a fourth aspect of the invention, in the apparatus for sorting and packaging articles according to any one of the first to third aspects of the invention, the articles are eggs, and each of the primary accommodating means has a plurality of accommodating pockets for accommodating from an upper direction the eggs released from the distributing conveyor with their long axes set substantially vertically and for releasing the accommodated eggs in a downward direction, the plurality of accommodating pockets being adapted to release the accommodated eggs collectively in the downward direction.

In accordance with a fifth aspect of the invention, in the apparatus for sorting and packaging articles according to any one of the first to fourth aspects of the invention, the transfer of the group of articles from one of the transferring means to the common filling means and the transfer of the group of articles from another one of the transferring means to the common filling means are effected selectively so that the transfers will not interfere with each other.

In accordance with a sixth aspect of the invention, in the apparatus for sorting and packaging articles according to any one of the first to fifth aspects of the invention, the group of articles to be transferred from the transferring means to the common filling means is selected on the basis of at least one of present numbers of groups of articles on standby in the plurality of the standby accommodating means and numbers of articles determined to be released to the plurality of the primary accommodating means and being transported by the plurality of the distributing conveyors.

In accordance with the invention, it is possible to provide a sorting and packaging apparatus which is capable of appropriately coping with a case in which articles in a particular classification must be sorted and packaged in a temporarily concentrated manner, while enhancing the processing capability by translating two or more distributing conveyors for transporting the articles preferably in a single line without increasing the number of packaging devices.

The above and other objects, features and advantages of the present invention will become more apparent from the following detailed description of the invention when read in conjunction with the accompanying drawings.

DESCRIPTION OF THE PREFERRED EMBODIMENTS

Figure 1:
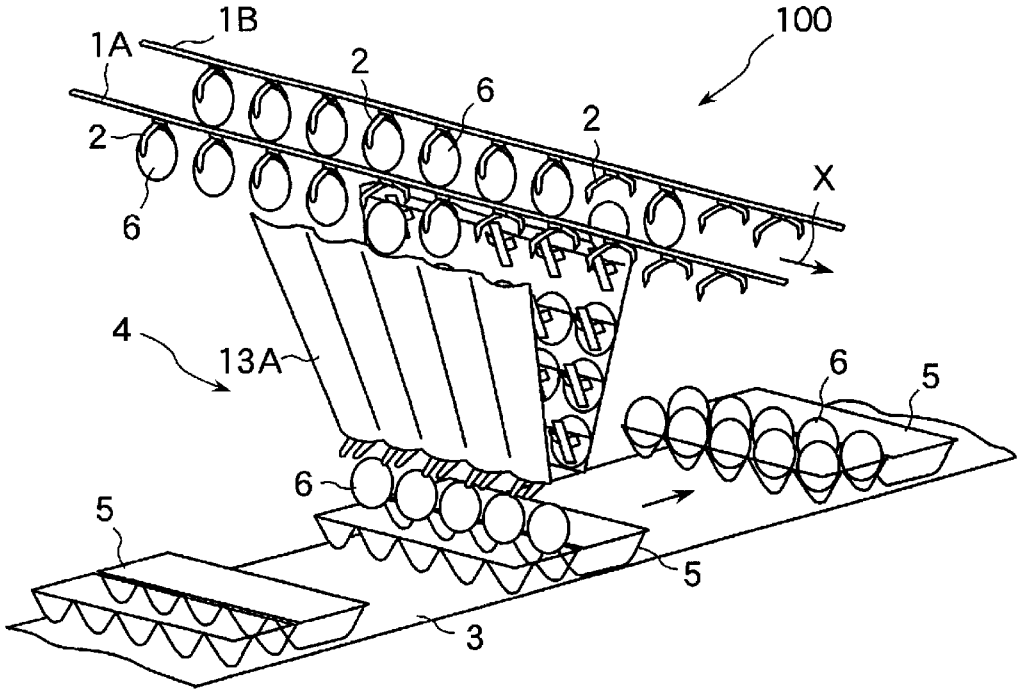
FIG. 1 is a detailed perspective view of a sorting and packaging apparatus which is applied as an apparatus for sorting and packaging eggs in accordance with a preferred embodiment of the invention.
Figure 2:
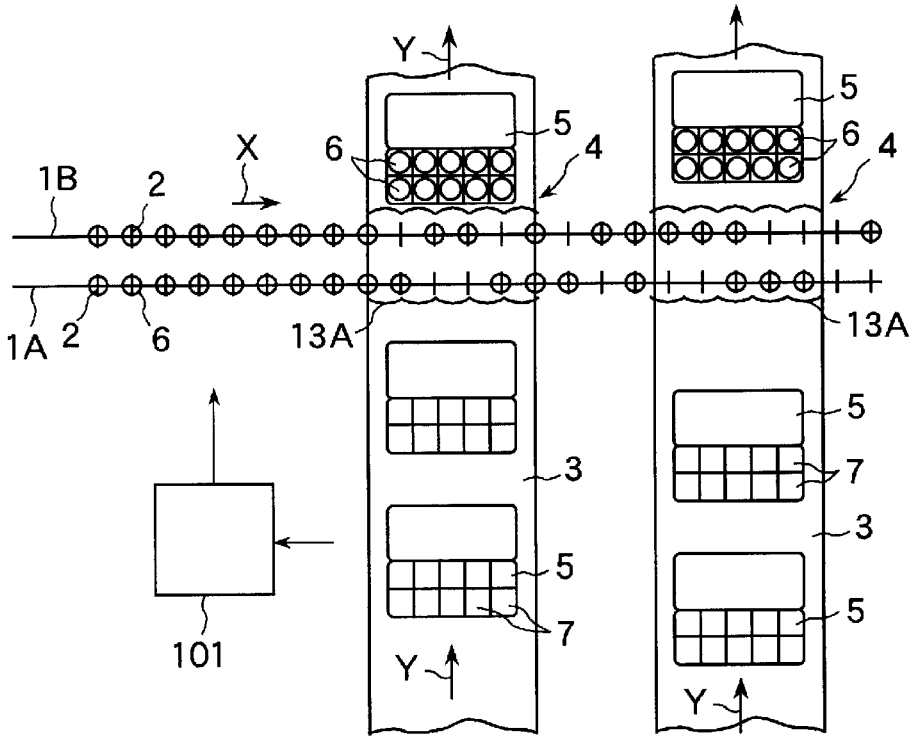
FIG. 2 is a schematic plan view of the apparatus for sorting and packaging eggs in accordance with the embodiment of the invention.

Referring now to the accompanying drawings, a detailed description will be given of a preferred embodiment of the invention in which eggs are used as articles.

The processing of sorting and packaging a large volume of eggs 6 is generally effected in a series of processes involving washing, arrangement (arrangement of pointed ends in order), inspection, weight measurement, distribution (sorting), and packaging. In a sorting and packaging apparatus 100 shown in FIGS. 1 to 4, a washing device, an arranging device, an inspecting device, and a weight measuring device are omitted. In FIGS. 1 to 4, the sorting and packaging apparatus 100 has a plurality of distributing conveyors 1A and 1B which are translated and each adapted to convey the eggs 6 in a single row, as well as a plurality of packaging devices 4. The packaging devices 4 are installed in a number corresponding to at least the number of weight classifications of the eggs 6. For example, in a case where the eggs 6 are sorted out in seven weight classifications including 2L, L, M, MS, S, 2S, and nonstandards, at least seven packaging devices 4 are installed. Since each of the packaging devices 4 has the same construction, a detailed description will be given hereafter of one packaging device 4.

The packaging device 4 is comprised of the following: primary accommodating means 11A and 11B which are respectively disposed below the distributing conveyors 1A and 1B and accommodate the eggs 6, which have been distributed and released from the respective distributing conveyors 1A and 1B, as a group in the form of a row; standby accommodating means 12A and 12B which are respectively disposed below the primary accommodating means 11A and 11B and accommodate for each of the groups of the eggs 6 one or more groups of the eggs 6 which have been collectively transferred from the respective primary accommodating means 11A and 11B; transferring means 18A and 18B which are respectively disposed below the standby accommodating means 12A and 12B and receive the groups of the eggs 6 from the respective standby accommodating means 12A and 12B; a common filling means 14 which is disposed below the moving means 18A and 18B and fills a packaging container 5 with the groups of the eggs 6 received from the respective moving means 18A and 18B; and a plurality of endless container conveyors 3 for intermittently conveying the packaging containers 5 such as egg packs and paper trays. As will be described later, the moving means 18A and 18B are adapted to selectively transfer the groups of the eggs 6 received from the respective standby accommodating means 12A and 12B to the common filling means 14.

The endless distributing conveyors 1A and 1B, which are disposed in parallel to each other and are translated in an X direction, are adapted to convey the eggs 6, whose individual weight has been measured, in the direction X perpendicular to a conveying direction Y of the container conveyor 3 while holding the eggs 6 with fingers 2.

The container conveyors 3 are installed in a number corresponding to at least the number of weight classifications of the eggs 6. For example, in a case where the eggs 6 are sorted out in seven weight classifications including 2L, L, M, MS, S, 2S, and nonstandards, at least seven container conveyors 3 are installed.

In the primary accommodating means 11A and 11B, the standby accommodating means 12A and 12B, and the transferring means 18A and 18B, the primary accommodating means 11A, the standby accommodating means 12A, and the transferring means 18A for the distributing conveyor 1A and the primary accommodating means 11B, the standby accommodating means 12B, and the transferring means 18B for the distributing conveyor 1B are configured in a similar manner. Therefore, a detailed description will be primarily given below of the primary accommodating means 11A, the standby accommodating means 12A, and the transferring means 18A. As for the primary accommodating means 11B, the standby accommodating means 12B, and the transferring means 18B, B will be appended to the same reference numerals, and a detailed description thereof will be omitted unless particularly required.

The primary accommodating means 11A includes an openable stopper 41A and a fixed guide 13A which is also common to the standby accommodating means 12A and the transferring means 18A. The standby accommodating means 12A includes an upper standby accommodating mechanism 12A-1 in an upper stage and a lower standby accommodating mechanism 12A-2 in a lower stage. The upper standby accommodating mechanism 12A-1 has the fixed guide 13A and an openable stopper 42A, while the lower standby accommodating mechanism 12A-2 has the fixed guide 13A and an openable stopper 43A.

The fixed guide 13A is formed of a corrugated plate-like member for forming a plurality of substantially trough-shaped passages thereon, and is adapted to guide the eggs 6 which are released from the fingers 2 when the fingers 2 are opened, such that the eggs 6 slide down thereon diagonally due to their own weight toward the filling means 14 disposed below a gap between the primary accommodating means 11A and 11B.

The primary accommodating means 11A disposed below the distributing conveyor 1A forms primary accommodating pockets 16A by means of the fixed guide 13A and the openable stopper 41A. If an example is cited in which two rows each consisting of five eggs are filled in a 10-pack packaging container 5 to complete their accommodation, the primary accommodating means 11A forms five primary accommodating pockets 16A by means of the fixed guide 13A and the openable stopper 41A, and is adapted to accommodate five eggs 6 in a row in the horizontal direction. Namely, the primary accommodating pockets 16A accommodates from an upper direction the eggs 6 released from the distributing conveyor 1A with their long axes set substantially vertically, and the plurality of primary accommodating pockets 16A are adapted to release the accommodated eggs 6 collectively in the downward direction.

When the five eggs 6 are accommodated in the primary accommodating pockets 16A in a row, an accommodation completion signal from a detector (not shown) for detecting the completion is transmitted to a control unit 101. Incidentally, instead of providing such a detector, the control unit 101 itself for controlling the release of the. eggs 6 from the fingers 2 to the primary accommodating means 11A may recognize the completion of the accommodation.

The standby accommodating means 12A has the upper and lower standby mechanisms 12A-1 and 12A-2 for allowing the group of eggs 6 from the primary accommodating means 11A to stand by. If the preceding upper standby mechanism 12A-1 disposed diagonally below the primary accommodating means 11A along the fixed guide 13A is capable of accepting the eggs 6 accommodated in the primary accommodating means 11A, the openable stopper 41A of the primary accommodating means 11A is opened on the basis of an accommodation allowance signal. Consequently, a horizontal row of five eggs 6 are collectively dropped due to their own weight and transferred as a group to the upper standby mechanism 12A-1 disposed diagonally below along the fixed guide 13A.

The upper standby mechanism 12A-1, which is a preceding standby mechanism for allowing the group of eggs 6 from the primary accommodating means 11A to stand by in a preceding manner, has the fixed guide 13A and the openable stopper 42A, and forms five standby accommodating pockets 17A-1 in the horizontal direction by means of the fixed guide 13A and the openable stopper 42A. The upper standby mechanism 12A-1 is thus adapted to accommodate the eggs 6 from the primary accommodating means 11A in the respective standby accommodating pockets 17A-1. Similarly, the lower standby mechanism 12A-2, which is a standby mechanism following the upper standby accommodating mechanism 12A-1, has the fixed guide 13A and the openable stopper 43A, and forms five standby accommodating pockets 17A-2 in the horizontal direction by means of the fixed guide 13A and the openable stopper 43A. The upper standby mechanism 12A-2 is thus adapted to accommodate the eggs 6 from the upper standby mechanism 12A-1 in the respective standby accommodating pockets 17A-2.

As for the standby accommodating pockets which are provided midway in the process of transfer of the eggs 6 from the primary accommodating means 11A to the filling means 14, it suffices if at least one row of the standby accommodating pockets are provided for the distributing conveyor 1A. In this embodiment, two rows of the standby accommodating pockets are provided as described above.

When five eggs are accommodated in the standby accommodating pockets 17A-1 in a row, the standby completion signal is transmitted to the control unit 101. If the standby accommodating pockets 17A-2 disposed diagonally below along the fixed guide 13A are capable of accepting the horizontal row of five eggs 6 waiting in the diagonally upper standby accommodating pockets 17A-1, the openable stopper 42A of the standby accommodating pockets 17A-1 is opened on the basis of the accommodation allowance signal. Consequently, the row of five eggs 6 are transferred collectively, i.e., as a group, due to their own weight to the standby accommodating pockets 17A-2 disposed diagonally below the standby accommodating pockets 17A-1 along the fixed guide 13A. Thus, the transfer operation in which the group of eggs 6 are transferred from the upper standby mechanism 12A-1 for allowing the group of eggs 6 from the primary accommodating means 11A to stand by in a preceding manner to the lower standby mechanism 12A-2 following the upper standby mechanism 12A-1 is effected on the basis of the state of standby of the group of eggs 6 in the lower standby mechanism 12A-2.

The transferring means 18A has the fixed guide 13A and an openable stopper 44A, which together form transfer accommodating pockets 19A. If the transferring means 18A is capable of accepting the group of five eggs 6 waiting in the lower standby accommodating pockets 17A-2 disposed diagonally thereabove, the openable stopper 43A of the standby accommodating pockets 17A-2 is opened on the basis of the accommodation allowance signal. Consequently, the row of five eggs 6 are transferred collectively, i.e., as a group, due to their own weight to the transfer accommodating pockets 19A along the fixed guide 13A.

The filling means 14 which is used jointly for the distributing conveyors 1A and 1B is disposed centrally below the gap between the pair of transferring means 18A and 18B, and has a pair of openable stoppers 15.

When the accommodation of the five eggs 6 in the transfer accommodating pockets 19A is completed, a transfer preparation completion signal from a detector (not shown) for detecting the completion is transmitted to the control unit 101. If the filling means 14 is capable of accepting the five eggs 6 accommodated in the transfer accommodating pockets 19A disposed diagonally thereabove, an accommodation allowance signal from a detector (not shown) for detecting the acceptability is transmitted to the control unit 101. Incidentally, instead of providing such a detector, the completion of the preparation of transfer and the acceptability may be recognized by the control unit 101 itself which controls the release of the eggs 6 from the lower standby mechanism 12A-2 to the transferring means 18A and controls the release of the eggs 6 from the filling means 14 to the packaging container 5. When the release is allowed, the openable stopper 44A of the transferring means 18A is opened, so that the row of five eggs 6 are transferred due to their own weight to the filling means 14 disposed diagonally below along the fixed guide 13A.

Since the filling means 14 is used jointly for the transfer accommodating pockets 19A and 19B, there are cases where the eggs 6 in either of the transfer accommodating pockets 19A and 19B are set in the state of standby depending on cases. Accordingly, if five eggs 6 are accommodated in both the transfer accommodating pockets 19A and 19B, the release of the eggs 6 from the accommodating pockets 19A and 19B to the filling means 14 is effected selectively so that they will not interfere with each other. Namely, the transfer of the eggs 6 is effected selectively so that the transfer of the group of eggs 6 to the common filling means 14 in the transferring means 18A and the transfer of the group of eggs 6 to the common filling means 14 in the transferring means 18B will not interfere with each other.

In this embodiment, the arrangement provided is such that, on the basis of the result of comparison between the number of groups of eggs 6 on standby in the standby accommodating pockets 17A-1 and 17A-2 on the distributing conveyor 1A side and the number of groups of eggs 6 on standby in the standby accommodating pockets 17B-1 and 17B-2 on the distributing conveyor 1B side, the group of eggs 6 of the moving means which receives the group of eggs 6 from the standby accommodating means having more numerous eggs on standby are preferentially released to the filling means 14. It should be noted that subjects of comparison may be those in which the number of eggs 6 accommodated in the primary accommodating pockets 16A or 16B is added to the number of groups of eggs 6 on standby in the standby accommodating pockets 17A or 17B. Still alternatively, between the transfer accommodating pockets 19A and 19B, the group of eggs 6 on the side where the accommodation of the group of eggs 6 was completed first may be preferentially released to the filling means 14.

Figure 3:
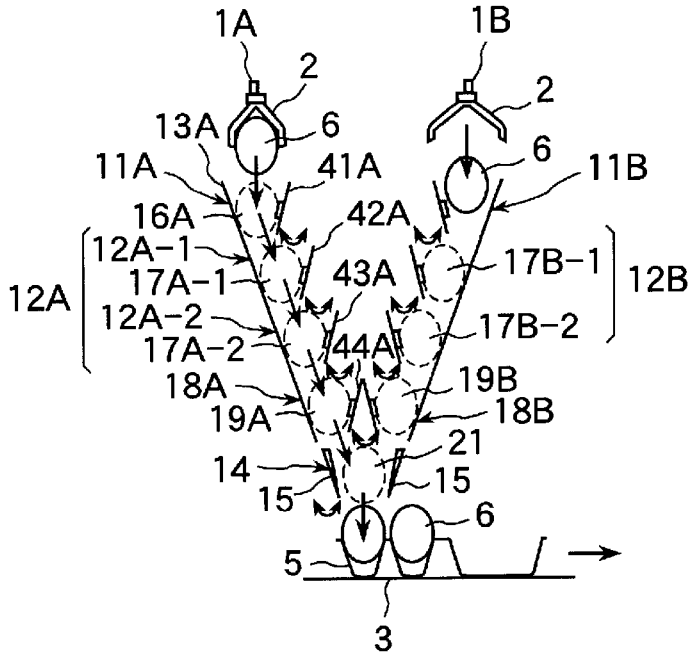
FIG. 3 is a side elevational view of the sorting and packaging apparatus shown in FIG. 1.

Furthermore, the numbers of eggs 6 which are determined to be distributed to the primary accommodating means 11A and 11B as a result of weight measurement and are approaching the primary accommodating means 11A and 11B on the distributing conveyors 1A and 1B, respectively, may be also used as subjects of comparison in addition to the present numbers of groups of eggs 6 on standby on the distributing conveyor 1A side and the distributing conveyor 1B side. Namely, since the eggs 6 after the measurement are distributed to the packaging devices 4 corresponding to the relevant weight classifications by the distributing conveyors 1A and 1B, as for the eggs 6 after the measurement, their positions and quantities are being grasped by the control unit 101 as information until they reach the packaging devices 4 to be distributed to. Consequently, for example, even if the total number of groups of eggs 6 being accommodated in the standby accommodating pockets 17A-1 and 17A-2 and the transfer accommodating pockets 19A on the distributing conveyor 1A side in FIG. 3 is less than the total number of groups of eggs 6 being accommodated in the standby accommodating pockets 17B-1 and 17B-2 and the transfer accommodating pockets 19B on the distributing conveyor 1B side, the number of eggs 6 which are determined to be distributed to the primary accommodating means 11A on the distributing conveyor 1A side and are approaching the packaging device 4 on the distributing conveyor 1A is more numerous than that on the distributing conveyor 1B side, priority is given to the release of the group of eggs 6 on standby in the transfer accommodating pockets 19A on the distributing conveyor 1A side so as to prevent a decline in the processing capability.

In this case, the numbers of eggs 6 which are determined to be distributed to the primary accommodating means 11A and 11B and are approaching the packaging devices 4 by the distributing conveyors 1A and 1B are also made subjects of comparison. In other words, the sorting and packaging apparatus 100 may select the group of eggs 6 to be transferred from the transferring means 18A or 18B to the common filling means 14 on the basis of at least one of the present numbers of groups on standby in the respective standby accommodating means 12A and 12B and the numbers of eggs 6 determined to be released to the primary accommodating means 11A and 11B and being transported by the distributing conveyors 1A and 1B.

It should be noted that in a case where, for example, the group of eggs 6 in the transfer accommodating pockets 19A are preferentially released after the selection, the group of eggs 6 in the transfer accommodating pockets 19B are set in the state of standby. However, since the weight of the eggs 6 varies in a certain measure as described above, even if the eggs 6 determined to be released are temporarily concentrated in the packaging device 4 corresponding to the packaging of the eggs of a particular weight classification, there are cases where the eggs 6 of the same weight classification are not transported for some time. For this reason, it suffices if the group of eggs 6 in the transfer accommodating pockets 19B placed on standby are released by making use of this spare time. Accordingly, even if the group of eggs 6 in the transfer accommodating pockets 19B are temporarily placed on standby, it becomes possible to prevent a decline in the overall processing capability of the apparatus by providing a plurality of standby accommodating pockets 19A and 19B on the distributing conveyor 1A side and the distributing conveyor 1B side along the fixed guide 13A.

The filling means 14 which is common to both the distributing conveyor 1A side and the distributing conveyor 1B side has the pair of openable stoppers 15. Upon receiving five eggs 6 released from the transfer accommodating pockets 19A, the filling means 14 confirms whether or not the 10-pack packaging container 5 has been prepared at the predetermined position, and then if the packaging container 5 is at the predetermined position, the filling means 14 opens the openable stoppers 15 in response to a release allowance signal. As a result, the five eggs 6 are collectively filled in the packaging container 5 by their own weight.

The packaging device 4 for a weight classification of the eggs 6 whose frequency of occurrence is low, e.g., for the weight classification 2L, may be arranged as follows. Assuming that the collection of a required number of eggs has been completed if the total of the eggs 6 accommodated in the pair of primary accommodating means 11A and 11B has become five without waiting for the five eggs 6 to be accommodated in the primary accommodating means 11A in a row, the total of five eggs 6 accommodated in the pair of primary accommodating means 11A and 11B are collectively transferred to the standby accommodating means 12A and 12B, and are collectively transferred sequentially down to the filling means 14. If such an arrangement is adopted, since the row of five eggs 6 are gathered in the final filling means 14, these eggs 6 are filled in the packaging container 5.

Figure 4:
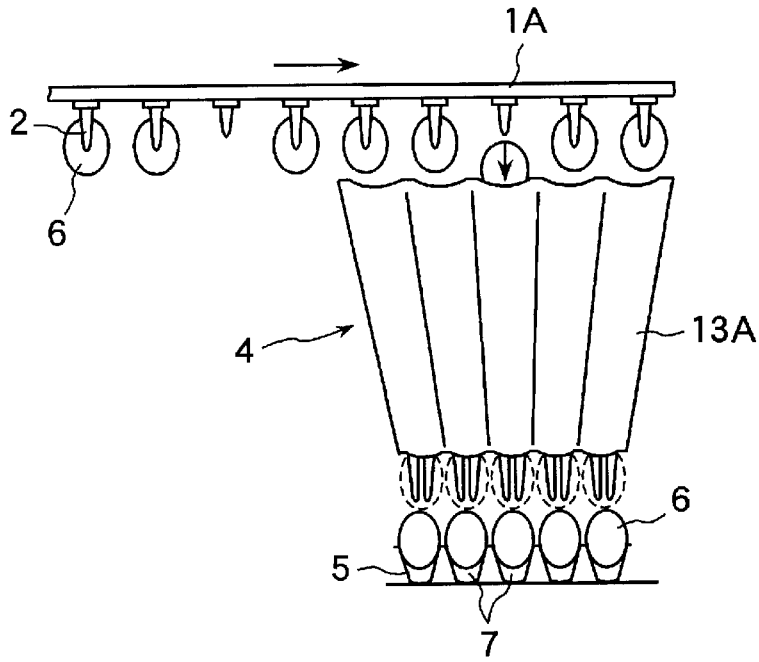
FIG. 4 is a front elevational view of the sorting and packaging apparatus shown in FIG. 1.

As is apparent from FIG. 4, in the downward order from the primary accommodating means 11A and 11B to the filling means 14 via the standby accommodating means 12A and 12B and the transferring means 18A and 18B, respective horizontal intervals between adjacent ones of the primary accommodating pockets 16A and 16B, the standby accommodating pockets 17A-1, 17A-2, 17B-1, and 17B-2, and the transfer accommodating pockets 19A and 19B are gradually narrowed, such that horizontal intervals between adjacent ones of filling accommodating pockets 21 in the filling means 14 are made identical to those between adjacent ones of accommodating seats 7 for the eggs 6 in the packaging container 5. By so doing, the transfer of the eggs 6, which are liable to be damaged, to the packaging container 5 can be effected safely at high speed and continuously.

Figure 5:
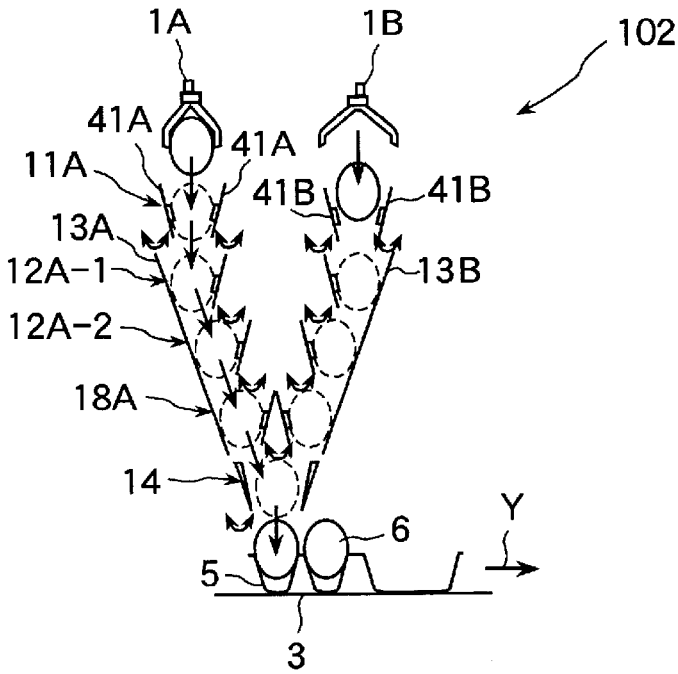
FIG. 5 is a side elevational view of another preferred embodiment of the invention.

It should be noted that, in another embodiment, as in the case of a sorting and packaging apparatus 102 shown in FIG. 5, each of the primary accommodating means 11A and 11B may be made independent from the fixed guides 13A and 13B, and may be formed by a pair of openable stoppers 41A and a pair of openable stoppers 41B, respectively.

Figure 6:
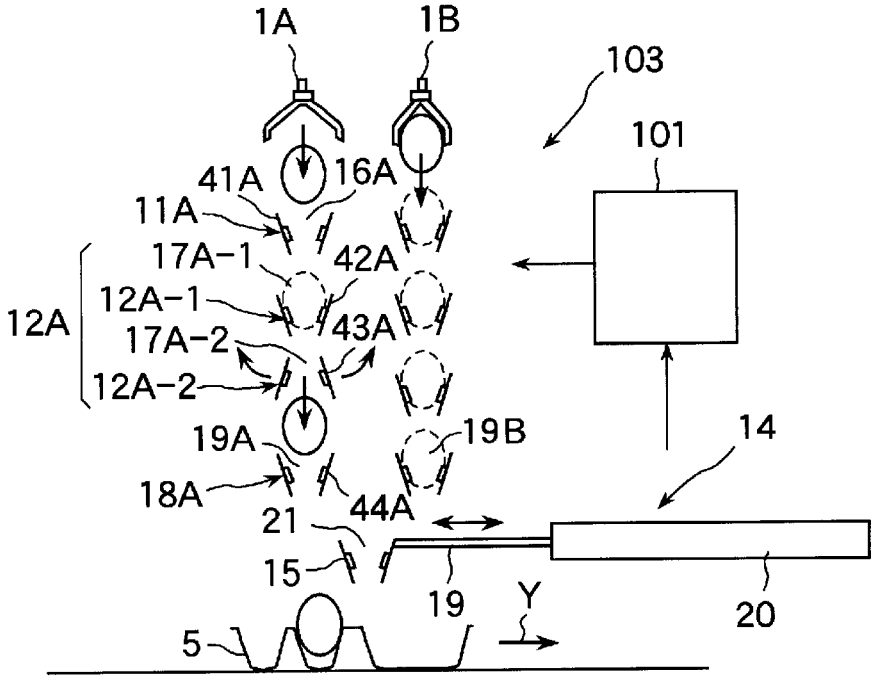
FIG. 6 is a side elevational view of still another preferred embodiment of the invention.

Next, still another embodiment of the invention will be shown in FIG. 6. In FIG. 6, the primary accommodating means 11A, the standby accommodating means 12A, and the transferring means 18A on the distributing conveyor 1A side and the primary accommodating means 11B, the standby accommodating means 12B, and the transferring means 18B on the distributing conveyor 1B side are configured in a similar manner in the same way as described above. Therefore, a description will be basically given below of the distributing conveyor 1A side.

Since the primary accommodating means 11A disposed immediately below the distributing conveyor 1A which is translated has the pair of openable stoppers 41A for forming the primary accommodating pockets 16A. The standby accommodating means 12A disposed immediately below the primary accommodating means 11A has the upper standby mechanism 12A-1 and the lower standby mechanism 12A-2. The upper standby mechanism 12A-1 has the pair of openable stoppers 42A, while the lower standby mechanism 12A-2 has the pair of openable stoppers 43A. The standby accommodating pockets 17A-1 and 17A-2 are formed in the downward order in the upper standby mechanism 12A-1 and the lower standby mechanism 12A-2, respectively. The transferring means 18A disposed immediately below the lower standby mechanism 12A-2 has the pair of openable stoppers 44A for forming the transfer accommodating pockets 19A.

The filling means 14, which is used jointly for the distributing conveyor 1A side and the distributing conveyor 1B side, has the pair of openable stoppers 15 for forming the filling accommodating pockets 21 as well as an electrically-operated cylinder 20 and an arm 19. The arrangement provided is such that as the arm 19 is actuated by the electrically-operated cylinder 20, the filling accommodating pockets 21 are moved to a position immediately below the transfer accommodating pockets 19A or transfer accommodating pockets 19B in which the eggs 6 subject to release are accommodated.

In a sorting and packaging apparatus 103 shown in FIG. 6, when five eggs 6 are accommodated horizontally in a row in the primary accommodating pockets 16A, an accommodation completion signal is transmitted from the primary accommodating means 11A to the control unit 101. If the upper standby mechanism 12A-1 disposed immediately below the primary accommodating means 11A is capable of accepting the eggs 6 accommodated in the primary accommodating means 11A, the upper standby mechanism 12A-1 outputs an accommodation allowance signal to the control unit 101, whereupon the control unit 101 opens the openable stoppers 41A of the primary accommodating means 11A. Consequently, the row of five eggs 6 accommodated in the primary accommodating pockets 16A are collectively transferred due to their own weight to the upper standby mechanism 12A-1 disposed immediately below.

When the row of five eggs 6 are accommodated in the standby accommodating pockets 17A-1, a standby completion signal is transmitted to the control unit 101. If the lower standby accommodating pockets 17A-2 disposed immediately below are capable of accepting the eggs 6 on standby in the standby accommodating pockets 17A-1 disposed immediately above, the lower standby accommodating pockets 17A-2 outputs an accommodation allowance signal to the control unit 101, whereupon the control unit 101 opens the openable stoppers 42A of the upper standby mechanism 12A-1 in response to the accommodation allowance signal. Consequently, the row of five eggs 6 are collectively transferred due to their own weight to the standby accommodating pockets 17A-2 disposed immediately below.

If the transferring means 18A is capable of accepting the group of eggs 6 on standby in the standby accommodating pockets 17A-2, the transferring means 18A outputs an accommodation allowance signal to the control unit 101, whereupon the control unit 101 opens the openable stoppers 43A of the lower standby mechanism 12A-2 in response to the accommodation allowance signal. Consequently, the row of five eggs 6 are collectively transferred due to their own weight to the transfer accommodating pockets 19A.

Upon completion of the accommodation of the five eggs 6 in the transfer accommodating pockets 19A, a transfer preparation completion signal is transmitted to the control unit 101. If the filling means 14 is capable of accepting the five eggs 6 accommodated in the transfer accommodating pockets 19A, the arm 19 is actuated by the electrically-operated cylinder 20, so that the filling accommodating pockets 21 can be moved to the position immediately below the transfer accommodating pockets 19A.

In this case as well, since the eggs 6 which are released from the two transfer accommodating pockets 19A and 19B on the distributing conveyor 1A side and the distributing conveyor 1B side are received by the single row of filling accommodating pockets 21, the release of the eggs from the transfer accommodating pockets 19A and 19B to the filling accommodating pockets 21 is effected selectively. The selection at that time is effected in the same way as in the above-described embodiment.

In the above-described manner, the five eggs 6 accommodated in the transfer accommodating pockets 19A are transferred to the filling accommodating pockets 21 of the filling means 14. Then, the filling means 14 confirms whether or not the 10-pack packaging container 5 has been prepared at the predetermined position, and then if the packaging container 5 is at the predetermined position, the filling means 14 opens the openable stoppers 15 in response to a release allowance signal. As a result, the five eggs 6 are collectively filled in the packaging container 5.

Although, in the sorting and packaging apparatus 103 shown in FIG. 6, the 10-pack packaging container 5 is filled with each group of five eggs 6 on two occasions, an arrangement may be alternatively provided as follows: In the embodiment shown in FIG. 6, two pairs of openable stoppers 15 are juxtaposed to the arm 19 so as to form two rows of filling accommodating pockets 21, and after the groups of five eggs 6 have been transferred from the transfer accommodating pockets 19A to the respective two rows of the filling pockets 21, these two groups of five eggs 6 are collectively filled in the 10-pack packaging container 5.

Figure 7:
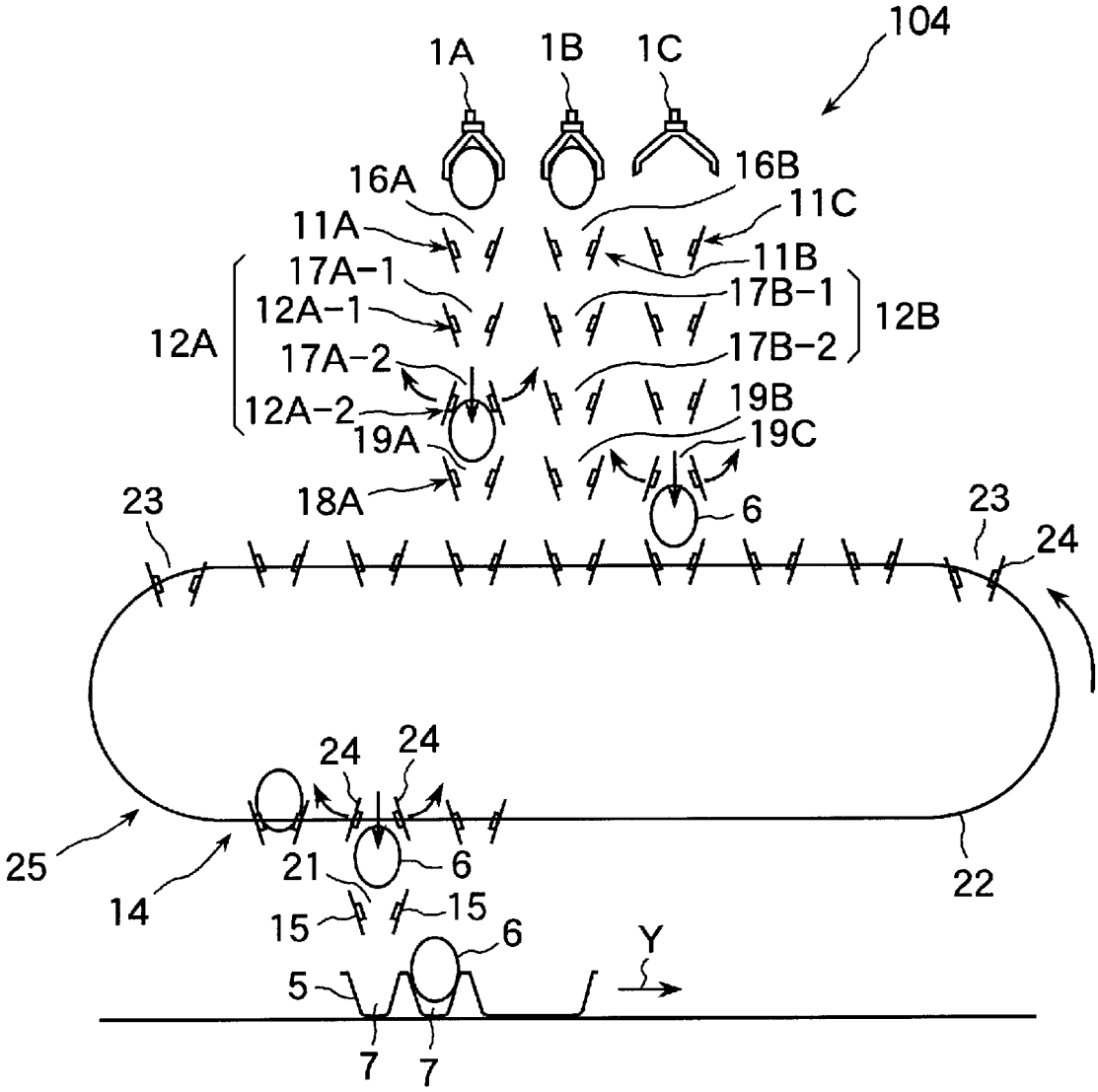
FIG. 7 is a side elevational view of the sorting and packaging apparatus using a transfer conveyor of a circulating system in accordance with a further preferred embodiment of the invention.

Next, a further embodiment of the invention is shown in FIG. 7. In a sorting and packaging apparatus 104 shown in FIG. 7, the primary accommodating means 11A, 11B, and 11C and the standby accommodating means 12A, 12B, and 12C are provided in the downward order immediately below three lines of distributing conveyors 1A, 1B, and 1C, respectively, which are translated. The sorting and packaging apparatus 104 is further provided with the transferring means 18A, 18B, and 18C which are respectively disposed below the standby accommodating means 12A, 12B, and 12C, as well as the filling means 14 which is common to the transferring means 18A, 18B, and 18C and includes an endless transfer conveyor 22 for receiving and circulatingly transferring horizontal rows of five eggs 6 released from the transferring means 18A, 18B, and 18C, as well as the pair of openable stoppers 15. Since the respective primary accommodating means 11A to 11C, standby accommodating means 12A to 12C, and so on for the distributing conveyors 1A, 1B, and 1C are configured in the same way as described above, a description will be basically given below of the primary accommodating means 11A, the standby accommodating means 12A, and so on for the distributing conveyor 1A. If necessary, reference will be also given to the primary accommodating means 11B and 11C, the standby accommodating means 12B and 12C, and so on which are disposed immediately below the two other lines of distributing conveyors 1B and 1C.

The upper and lower standby mechanisms 12A-1 and 12A-2 of the standby accommodating means 12A are disposed immediately below the primary accommodating means 11A. If the case of filling a 10-pack packaging container is cited as an example, the primary accommodating means 11A accommodates five eggs 6 in a row.

The transfer conveyor 22, in which accommodating seats 23 for accommodating horizontal rows of five eggs 6 are linked, is adapted to receive the eggs 6 from the transfer accommodating pockets 19A of the transferring means 18A, and collectively release five eggs 6 as a group from the accommodating seats 23 to the collecting accommodating pockets 21.

In the sorting and packaging apparatus 104 shown in FIG. 7, the transfer of the eggs 6 from the primary accommodating means 11A to the standby accommodating pockets 17A-1 and 17A-2 and to the transfer accommodating pockets 19A is basically the same as the sorting and packaging apparatus 103 shown in FIG. 6. Accordingly, a description will be given herein of the transfer of the eggs 6 from the transfer accommodating pockets 19A to the transfer conveyor 22. the transfer of the eggs 6 from the transfer conveyor 22 to the filling accommodating pockets 21, and the operation of filling the eggs 6 from the filling accommodating pockets 21 to the packaging container 5.

The row of five eggs 6 accommodated in the transfer accommodating pockets 19A are collectively released to the relevant accommodating seats 23 of the transfer conveyor 22 when a row of five empty accommodating seats 23 of the transfer conveyor 22 arrive at an egg releasing position below the transfer accommodating pockets 19A. Each of the accommodating seats 23 consists of a pair of openable stoppers 24 attached to the transfer conveyor 22 and similar to the openable stoppers 15.

The row of five eggs 6 accommodated in the accommodating seats 23 are transported to a release position above the filling accommodating pockets 21 by the transfer conveyor 22. If the filling accommodating pockets 21 are empty, an accommodation allowance signal is outputted to the control unit 101, and the row of five eggs 6 in the accommodating seats 23 are released to the filling accommodating pockets 21.

Next, confirmation is made as to whether or not the 10-pack packaging container 5 has been prepared at a predetermined position, and if the packaging container 5 is at the predetermined position, the filling means 14 opens the openable stoppers 15 in response to a release allowance signal. Consequently, the five eggs 6 are collectively filled in the packaging container 5 due to their own weight.

If the packaging container 5 is not at the predetermined position for some reason or other, the filling means 14 is unable to release the row of five eggs 6 accommodated in the filling accommodating pockets 21 and remains holding the row of five eggs 6. Subsequently, even if another row of five eggs 6 in the accommodating seats 23 arrive at the release position above the filling accommodating pockets 21 by the transfer conveyor 22, since the row of five eggs 6 are already present in the filling accommodating pockets 21, the new row of five eggs 6 in the other accommodating seats 23 cannot be released to the filling accommodating pockets 21. Accordingly, in preparation for such a situation, the transport conveyor 22 is adapted to carry over and circulatingly transport the row of five eggs 6 in the accommodating seats 23 which could not be released to the filling accommodating pockets 21. The common filling means 14 of the sorting and packaging apparatus 104 in this embodiment has a transporting means 25 which transports the groups of eggs 6 from the transferring means 18A, 18B, and 18C in a circulating system and which is comprised of the transfer conveyor 22 and the multiplicity of openable stoppers 24.

It should be noted that, in the sorting and packaging apparatus 104, if it is assumed that the processing capability of one distributing conveyor 1A is 30,000 eggs per hour, the processing capability of the three distributing conveyors 1A, 1B, and 1C as a whole becomes 90,000 eggs per hour. Then, if a case is assumed in which the eggs 6 are continuously concentrated in the respective primary accommodating means 11A, 11B, and 11C of the three distributing conveyors 1A, 1B, and 1C, 90,000 eggs per hour is required on calculation as the processing capability of the transporting means 25. However, since the weight of the eggs 6 varies in a certain measure, the possibility of the eggs 6 being continuously concentrated in the relevant primary accommodating means 11A, 11B, and 11C of the three distributing conveyors 1A, 1B, and 1C at the same time is small. Hence, if a means for receiving the temporary concentration is provided appropriately, there is actually no need to set the processing capability of the transporting means 25 to 90,000 eggs per hour.

In addition, in the sorting and packaging apparatus 104 shown in FIG. 7, there are cases where the eggs 6 are temporarily concentrated in the primary accommodating means for at least one of the three distributing conveyors 1A, 1B, and 1C. For example, there are cases in which the eggs 6 are continuously concentrated in the primary accommodating means 11A and 11B for the distributing conveyors 1A and 1B, and the rows of five eggs 6 are accommodated in the primary accommodating pockets 16A and 16B, the upper and lower standby accommodating pockets 17A-1 and 17A-2 and 17B-1 and 17B-2, and the transfer accommodating pockets 19A and 19B which are disposed below the distributing conveyor 1A and the distributing conveyor 1B, respectively, whereas the row of five eggs are accommodated only in the transfer accommodating pockets 19C in the case of the distributing conveyor 1C.

In this case, if the processing capability of the transporting means 25 is lower than the total processing capability of the distributing conveyors 1A, 1B, and 1C, the release of the eggs 6 from the respective transfer accommodating pockets 19A, 19B, and 19C to the transporting means 25 is effected selectively. Namely, on the distributing conveyor 1C side, there is leeway in time to keep ensuing eggs 6, which are occasionally released from the distributing conveyor 1C, on standby in the standby accommodating pockets 17C-1 and 17C-2 even if the row of five eggs 6 accommodated in the relevant transfer accommodating pockets 19C are not immediately released to the accommodating seats 23 of the transfer conveyor 22. On the distributing conveyors 1A and 1B side, on the other hand, there is no leeway for standby since the rows of five eggs 6 are already accommodated in the standby accommodating pockets 17A-1, 17A-2, 17B-1, and 17B-2; therefore, the release of the eggs 6 to the accommodating seats 23 of the transfer conveyor 22 is effected by placing priority on the distributing conveyors 1A and 1B side.

Furthermore, in the case where the transporting means 25 is formed by the transfer conveyor 22 of the so-called circulating system, the row of five eggs 6 which could not be released to the filling accommodating pockets 21 are carried over and transported. However, if the number of the eggs 6 which are carried over and transported increases, the number of the empty accommodating seats 23 of the transfer conveyor 22 decreases correspondingly. Hence, in some cases it becomes difficult to release all the eggs 6 accommodated in the transfer accommodating pockets 19A, 19B, and 19C to the accommodating seats 23 of the transfer conveyor 22. In such a case, it suffices if the release of the eggs 6 from the transfer accommodating pockets 19A, 19B, and 19C to the accommodating seats 23 of the transfer conveyor 22 is effected selectively in the same way as described above.

It should be noted that although the above-described example is the case of the sorting and packaging apparatus concerning the weight of the eggs 6, to produce eye-catching eggs-packaged products in which white eggs and brown eggs are arranged in a zigzag manner in the packaging container 5, a sorting and packaging apparatus concerning the white eggs and brown eggs may be constructed in the same way as described above. Still further, a sorting and packaging apparatus concerning the size, color, and the like of such as fruits, other than the eggs 6, may be constructed in the same way as described above.

What is claimed is:

1. An apparatus for sorting and packaging articles, comprising:

at least first and second distributing conveying means for conveying the articles independently with each other to distribute the articles based on predetermined classifications with respect to a property of the article;

a first precedingly accommodating means disposed below said first distributing conveying means for precedingly receiving the articles belonging in one of said predetermined classifications and distributed from said first distributing conveying means, said first precedingly accommodating means having a plurality of accommodating pockets disposed in a row in a direction parallel to a conveying direction of said first distributing conveying means for accommodating said received articles and keeping the same on standby, respectively;

a second precedingly accommodating means disposed below said second distributing conveying means for precedingly receiving the articles belonging in said one of predetermined classifications and distributed from said second distributing conveying means, said second precedingly accommodating means having a plurality of accommodating pockets disposed in a row in a direction parallel to a conveying direction of said second distributing conveying means for accommodating said received articles and keeping the same on standby, respectively;

a first succeedingly accommodating means disposed fixedly below said first precedingly accommodating means for collectively receiving only the articles issued collectively from said plurality of accommodating pockets of the first precedingly accommodating means, said first succeedingly accommodating means having a plurality of accommodating pockets disposed fixedly in a row for accommodating said collectively received articles and keeping the same on standby, respectively, and corresponding to said plurality of accommodating pockets of said first precedingly accommodating means in number;

a second succeedingly accommodating means disposed fixedly below said second precedingly accommodating means for collectively receiving only the articles issued collectively from said plurality of accommodating pockets of the second precedingly accommodating means, said second succeedingly accommodating means having a plurality of accommodating pockets disposed fixedly in a row for accommodating said collectively received articles and keeping the same on standby, respectively, and corresponding to said plurality of accommodating pockets of said second precedingly accommodating means in number; and common filling means disposed below said first and second succeedingly accommodating means for collectively commonly receiving said articles issued selectively from said plurality of accommodating pockets of said first and second succeedingly accommodating means and for collectively filling the collectively received articles into a predetermined container;

said first and second distributing conveying means distributing the articles belonging in said one of the predetermined classifications to said first and second precedingly accommodating means, respectively.

2. An apparatus for sorting and packaging articles according to claim 1, further comprising a first intermediate accommodating means disposed between said first precedingly accommodating means and said first succeedingly accommodating means for collectively receiving the articles issued collectively from said plurality of accommodating pockets of the first precedingly accommodating means, and a second intermediate accommodating means disposed between said second precedingly accommodating means and said second succeedingly accommodating means for collectively receiving the articles issued collectively from said plurality of accommodating pockets of the second precedingly accommodating means, said first intermediate accommodating means collectively transferring the articles collectively received from said first precedingly accommodating means to said first succeedingly accommodating means, said second intermediate accommodating means collectively transferring the articles collectively received from said second precedingly accommodating means to said second succeedingly accommodating means, said first and second intermediate accommodating means each having a plurality of accommodating pockets for accommodating said collectively received articles and keeping the same on standby, respectively.

3. The apparatus for sorting and packaging articles according to claim 1, wherein said first and second precedingly accommodating means transfer the accommodated articles therein from said plurality of accommodating pockets thereof to said plurality of accommodating pockets of said first and second succeedingly accommodating means on the basis of a state of standby of said articles in said plurality of accommodating pockets of said first and second succeedingly accommodating means, respectively.

4. An apparatus for sorting and packaging articles according to claim 1, wherein said common filling means has circulating means for receiving and circulating the articles issued selectively from said plurality of accommodating pockets of said first and second succeedingly accommodating means.

5. An apparatus for sorting and packaging articles according to claim 1, wherein the articles are eggs, and each of said plurality of accommodating pockets of said first and second precedingly accommodating means accommodates the eggs with their long axes set substantially vertically from an upper position and downwardly releases the accommodated eggs therein collectively.

6. An apparatus for sorting and packaging articles according to claim 1, wherein said first and second succeedingly accommodating means each issues the articles therein on the basis of at least one of present numbers of collective articles on standby in said first and second precedingly accommodating means, present numbers of collective articles on standby in said first and second succeedingly accommodating means, and numbers of articles determined to be distributed to said first and second precedingly accommodating means and being transported by said first and second distributing conveying means.

7. An apparatus for sorting and packaging articles, comprising:

at least first and second distributing conveying means for conveying the articles independently with each other to distribute the articles based on predetermined classifications with respect to a property of the article;

a first precedingly accommodating means disposed below said first distributing conveying means for precedingly receiving the articles belonging in one of said predetermined classifications and distributed from said first distributing conveying means, said first precedingly accommodating means having a plurality of accommodating pockets disposed in a row in a direction parallel to a conveying direction of said first distributing conveying means for accommodating said received articles and keeping the same on standby, respectively;

a second precedingly accommodating means disposed below said second distributing conveying means for precedingly receiving the articles belonging in said one of predetermined classifications and distributed from said second distributing conveying means, said second precedingly accommodating means having a plurality of accommodating pockets disposed in a row in a direction parallel to a conveying direction of said second distributing conveying means for accommodating said received articles and keeping the same on standby, respectively;

a first succeedingly accommodating means disposed stationarily below said first precedingly accommodating means for collectively receiving the articles issued collectively from said plurality of accommodating pockets of the first precedingly accommodating means, said first succeedingly accommodating means having a plurality of accommodating pockets disposed in a row in a direction parallel to a conveying direction of said first distributing conveying means for accommodating said collectively received articles and keeping the same on standby, respectively, said plurality of accommodating pockets of said first succeedingly accommodating means being disposed stationarily in a direction perpendicular to said conveying direction of said first distributing conveying means and corresponding to said plurality of accommodating pockets of said first precedingly accommodating means in number;

a second succeedingly accommodating means disposed stationarily below said second precedingly accommodating means for collectively receiving the articles issued collectively from said plurality of accommodating pockets of the second precedingly accommodating means, said second succeedingly accommodating means having a plurality of accommodating pockets disposed in a row in a direction parallel to said conveying direction of said second distributing conveying means for accommodating said collectively received articles and keeping the same on standby, respectively, said plurality of accommodating pockets of said second succeedingly accommodating means being disposed stationarily in a direction perpendicular to said conveying direction of said second distributing conveying means and corresponding to said plurality of accommodating pockets of said second precedingly accommodating means in number; and common filling means disposed below said first and second succeedingly accommodating means for collectively commonly receiving said articles issued selectively from said plurality of accommodating pockets of said first and second succeedingly accommodating means and for collectively filling the collectively received articles into a predetermined container, said common filling means having a plurality of accommodating pockets which is disposed in a row in a direction parallel to said conveying directions of said first and second distributing conveying means, and which is disposed movably in a direction perpendicular to said conveying directions of said first and second distributing conveying means in order to collectively fill the collectively received articles into said predetermined container;

said first and second distributing conveying means distributing the articles belonging in said one of the predetermined classifications to said first and second precedingly accommodating means, respectively.

8. An apparatus for sorting and packaging articles according to claim 7, further comprising a first intermediate accommodating means disposed stationarily between said first precedingly accommodating means and said first succeedingly accommodating means for collectively receiving the articles issued collectively from said plurality of accommodating pockets of the first precedingly accommodating means, and a second intermediate accommodating means disposed stationarily between said second precedingly accommodating means and said second succeedingly accommodating means for collectively receiving the articles issued collectively from said plurality of accommodating pockets of the second precedingly accommodating means, said first intermediate accommodating means collectively transferring the articles collectively received from said first precedingly accommodating means to said first succeedingly accommodating means, said second intermediate accommodating means collectively transferring the articles collectively received from said second precedingly accommodating means to said second succeedingly accommodating means, said first and second intermediate accommodating means each having a plurality of accommodating pockets disposed in a row in a direction parallel to said conveying directions of said first and second distributing conveying means and disposed stationarily in a direction perpendicular to said conveying directions of said first and second distributing conveying means for accommodating said collectively received articles and keeping the same on standby, respectively.

9. An apparatus for sorting and packaging articles according to claim 7, wherein said first and second precedingly accommodating means transfer the accommodated articles therein from said plurality of accommodating pockets thereof to said plurality of accommodating pockets of said first and second succeedingly accommodating means on the basis of a state of standby of said articles in said plurality of accommodating pockets of said first and second succeedingly accommodating means, respectively.

10. An apparatus for sorting and packaging articles according to claim 7, wherein said common filling means has circulating means for receiving and circulating the articles issued selectively from said plurality of accommodating pockets of said first and second succeedingly accommodating means.

11. An apparatus for sorting and packaging articles according to claim 7, wherein the articles are eggs, and each of said plurality of accommodating pockets of said first and second precedingly accommodating means accommodates the eggs with their long axes set substantially vertically from an upper position and downwardly releases the accommodated eggs therein collectively.

12. An apparatus for sorting and packaging articles according to claim 7, wherein said first and second succeedingly accommodating means each issues the articles therein on the basis of at least one of present numbers of collective articles on standby in said first and second precedingly accommodating means, present numbers of collective articles on standby in said first and second succeedingly accommodating means, and numbers of articles determined to be distributed to said first and second precedingly accommodating means and being transported by said first and second distributing conveying means.

* * * * *